United States Patent [19]

Holstein

[11] 4,299,072

[45] Nov. 10, 1981

[54] TURRET DRIVE SYSTEM

[75] Inventor: John H. Holstein, 5304 N. Colonial - No. 102, Fresno, Calif. 93704

[73] Assignee: John H. Holstein, Fresno, Calif.

[21] Appl. No.: 4,161

[22] Filed: Jan. 17, 1979

[51] Int. Cl.[3] ..... B67B 3/08; B67B 3/20

[52] U.S. Cl. ..... 53/306; 53/331.5; 74/802

[58] Field of Search ..... 74/802, 801, 804, 813 R, 74/821; 53/317, 306, 308, 277, 331.5; 198/626, 627, 621, 624

[56] References Cited

U.S. PATENT DOCUMENTS

| | | | |
|---|---|---|---|
| 2,187,429 | 1/1940 | Newey | 53/317 |
| 3,852,941 | 12/1974 | Bross | 53/317 |
| 3,955,435 | 5/1976 | Arick | 74/802 X |
| 4,089,153 | 5/1978 | Long | 53/317 X |
| 4,137,797 | 2/1979 | Brems | 74/801 |

*Primary Examiner*—Horace M. Culver

*Attorney, Agent, or Firm*—Hill, Van Santen, Steadman, Chiara & Simpson

[57] ABSTRACT

A system is disclosed for effecting movement of one or more operating devices such as capper chucks through a predetermined endless path having a straight line reach parallel to a conveyor on which containers or the like may be conveyed, the system including a fixed turret defining the endless path and being adapted to support and guide one or more devices along the endless path and having drive means cooperative with each operative device so as to effect constant speed movement of the devices along the straight line reach and, in a preferred embodiment, also effect rotation of the devices about their longitudinal axes as they traverse the endless guide track.

17 Claims, 8 Drawing Figures

18
10
120
144
146
156
152
154
87
90
88
84
86
120a
218
216
200
204
206
190a
198b
198
198a
122a
180
182
122
126
3.
214
222a
202
162b
188
160
80
78
72
212
228a
5.
192
124
190
194
74a
76
74b
172
162a
4.
66
100
68
210
98a
96
98
104
222b
190b
6.
186
164
166
170
168
174
178
130
134
132
60
64
62
20
22
24
106
108a
56
58
32a
92
94
12
50
44
52
112
46
48
54
108
110
108b
36
34
30
40
42
32
28b
28a
14

142
120
144a
144b
146
144c
144
154
87
52
156
18
226
86
216
214
218
222a
210
80
212
224
72
78
74a
74b
76
210
66
222b
22
12

TURRET DRIVE SYSTEM

The present invention relates generally to systems for guiding operating devices such as capper chucks and the like through predetermined paths, and more particularly to a novel drive system employing a fixed turret adapted to support and guide one or more operative devices for movement through a predetermined endless path and including drive means cooperative with each device to effect constant speed movement of the devices along a straight line reach of the guide path. In a preferred embodiment, the drive means associated with each operating device is also adapted to effect rotation of the devices as they traverse the guide path.

In applying closure caps to containers, such as by applying a prethreaded closure cap to the threaded neck portion of a container or by roll forming a depending annular skirt of a closure blank against an external thread conformation on a container, it is known to sequentially move one or more capper chucks along a predetermined path at least a portion of which overlies or closely parallels a path along which containers are conveyed so that each container is brought into predetermined registration with a capper chuck. In the case of roll-on capper chucks, each container carries a suitable closure blank on its upper threaded neck end adapted to be engaged by a capper chuck which is rotated to roll form the closure skirt against the thread conformations on the container. In the case of preformed continuous thread closure caps, the capper chucks are each operated to pick up a closure cap between its gripper jaws prior to axial registration with a container so that subsequent rotation and movement of the capper chucks into operative relation with the containers applies the caps to the containers. Capper chucks of the type adapted to apply a preformed continuous thread closure cap onto an externally threaded neck of a container are disclosed in U.S. Pat. No. 3,805,488, dated Apr. 23, 1974, and in my copending application, Ser. No. 930,053, filed Aug. 1, 1978, and entitled Capper Chuck. Capper chucks of the type adapted to apply closure caps to containers by roll forming an annular skirt of the closure against a thread conformation on the container are disclosed in U.S. Pat. No. 3,878,667, dated Apr. 22, 1975, and in my copending application, Ser. No. 930,054, filed Aug. 1, 1978, and entitled Roll-On Capper Chuck.

In the prior systems for effecting high speed application of closure caps to containers, it has been suggested to move a plurality of capper chucks along a predetermined endless path, frequently being generally oval and termed a "racetrack", by mounting the capper chucks on individual support carriages which are in turn mounted on an endless track system for movement therealong. See, for example U.S. Pat. No. 3,454,142, dated July 8, 1969. In these prior systems, the individual carriages and associated capper chucks are moved along the endless track by a puller chain or linkage arrangement driven by a sprocket drive. During movement of the capper chucks along a straight-line reach of the track, it is proposed that the chucks be caused to apply closure caps onto containers which are moved along a path parallel to the straight-line reach of the racetrack by a conveyor.

One of the primary objects of the present invention is to provide a novel system for effecting guided movement of a plurality of operating devices such as capper chucks and the like through an endless guide path.

A more particular object of the present invention is to provide a novel system for supporting and guiding a plurality of operative devices such as capper chucks or the like through an endless guide path, which system employs a fixed turret defining an endless guide track having at least one straight-line reach and on which the operating devices are supported for movement along the guide track, and drive means cooperative with the operative devices and operative to move the operative devices along the endless guide path at substantially constant predetermined speed through the straight-line reach thereof, thus permitting operations to be performed on containers as they undergo straight line movement.

Another object of the present invention is to provide a novel system for supporting and guiding a plurality of operating devices such as capper chucks or the like through an endless guide path, wherein the drive means cooperative with the operating devices for effecting movement thereof about the fixed turret is also operative to effect rotation of the operating devices about their longitudinal axes as they traverse the endless guide track.

A feature of the system of the present invention lies in the provision of a generally horizontally disposed relatively fixed turret plate having cam grooves therein operative to support and guide one or more operating devices such as capper chucks through a predetermined endless guide path, and having additional cam grooves adapted to guide connecting linkages and individual gear trains interconnecting each of the operating devices to a drive shaft disposed centrally of the turret so as to effect substantially constant speed movement of the operating devices along a straight-line reach of the guide track and, preferably, also effect rotation of the operating devices about their longitudinal axes as they traverse the endless guide path.

Another feature of the system of the present invention lies in the provision of a turret plate which defines an endless guide path for the operating devices having varying distance from the central drive shaft, and wherein the gear trains are operative to interconnect the operating devices to a centrally disposed drive pinion and maintain rotation of the operating devices about their longitudinal axes as they traverse the guide path.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 7:
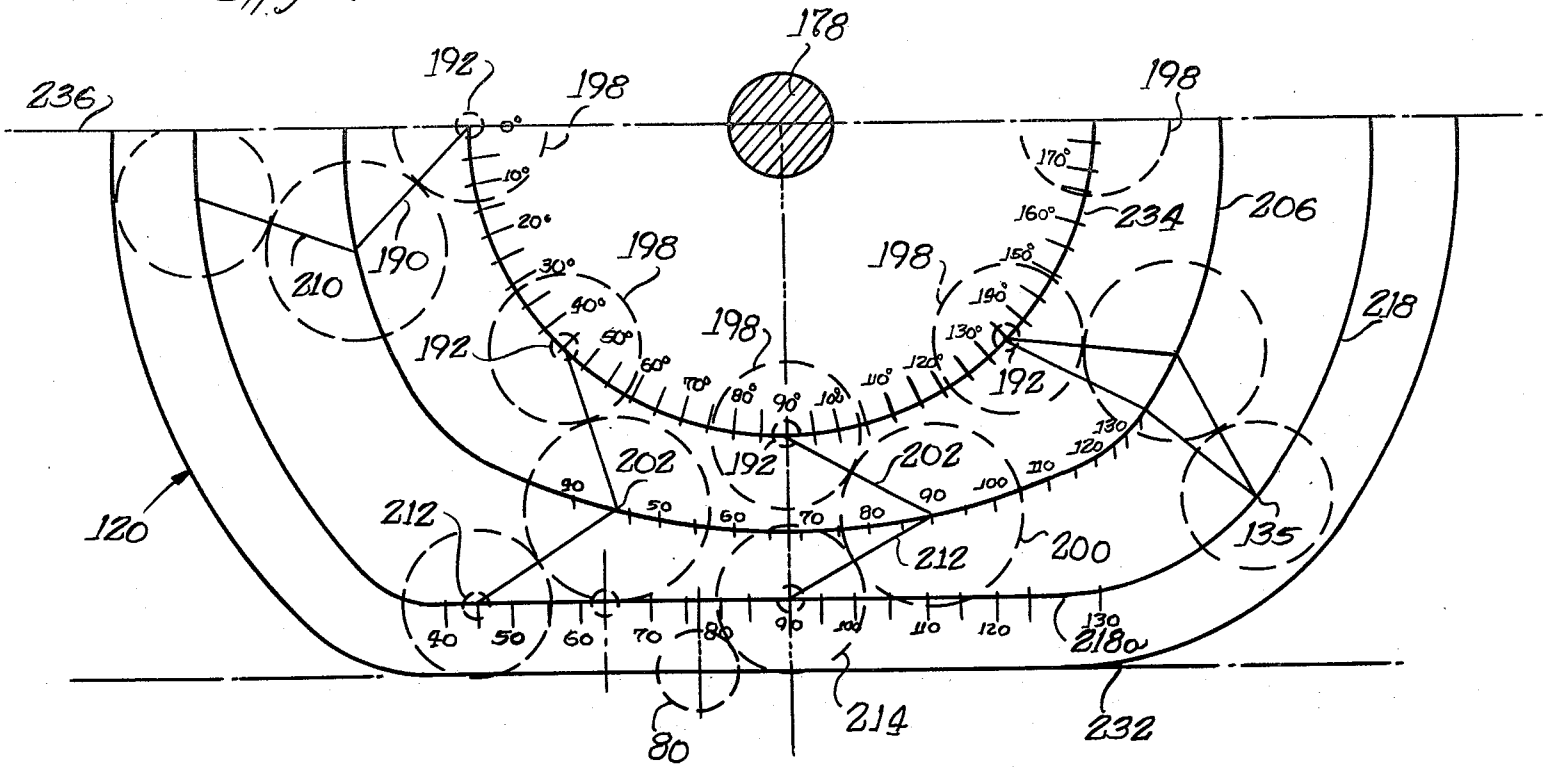
Figure 7A:
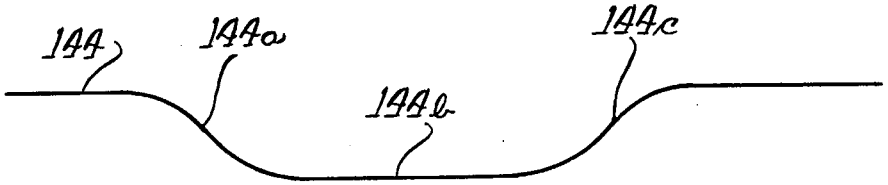

FIG. 7 schematically illustrates an example of the relationship of the cam grooves in the turret plate so as to obtain substantially constant linear travel of the capper chucks along a straight-line reach of the turret guide path, and FIG. 7*a* schematically illustrates an example of the relation of the elevational control cam in the turret plate to the planar cam grooves of FIG. 7 for effecting predetermined vertical movement of the capper chucks during a capping operation.

Figure 1:
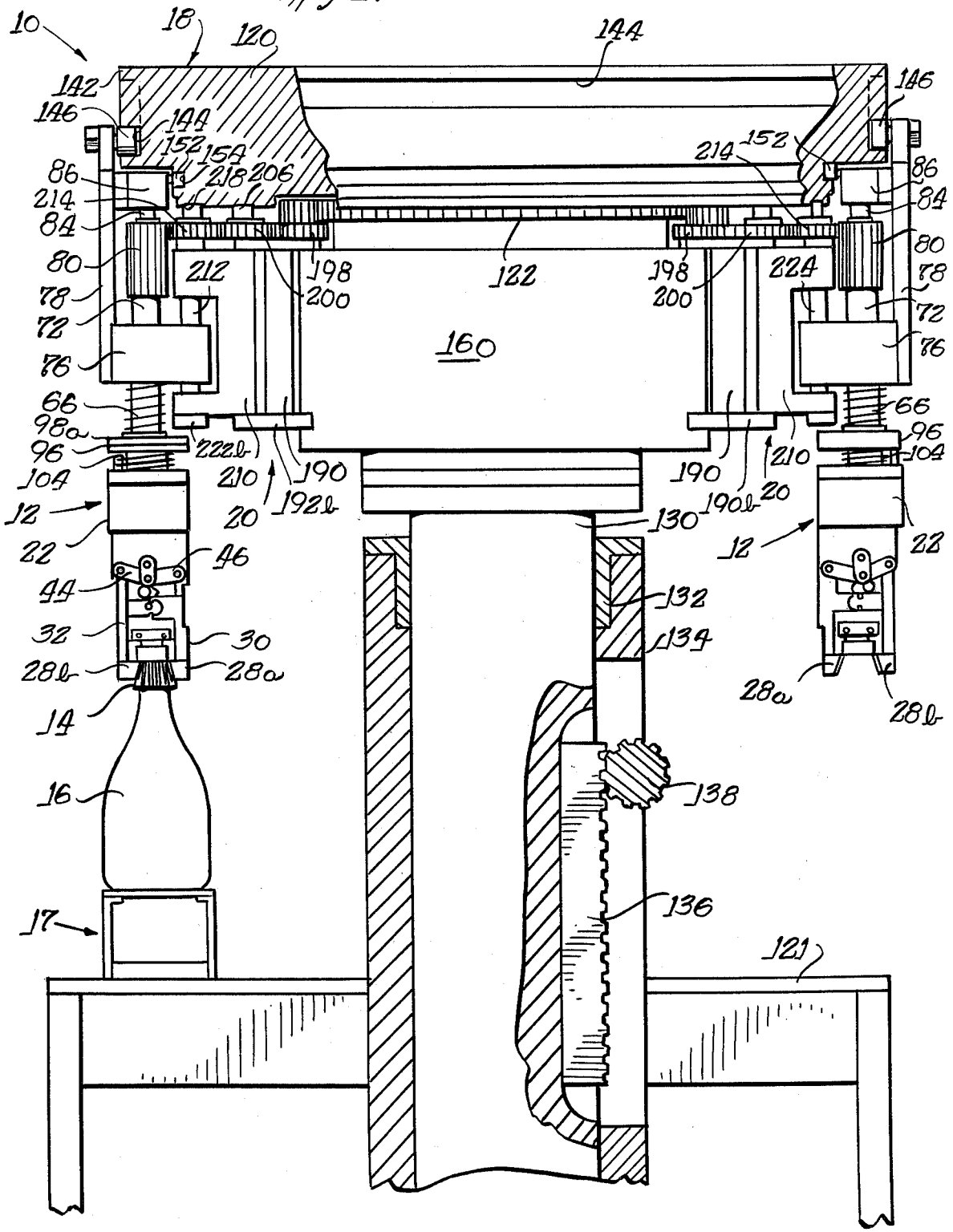
FIG. 1 is a fragmentary elevational view illustrating a turret drive system constructed in accordance with the present invention in operative association with capper chucks, portions being broken away for clarity.

Referring now to the drawings, and in particular to FIG. 1, a turret drive system constructed in accordance with the present invention is indicated generally at 10. Very generally, the turret drive system 10 is adapted to effect predetermined movement of a plurality of operating devices such as capper chucks and like devices through an endless guide path while effecting rotation of the operating devices about their longitudinal axes. In the illustrated embodiment, a plurality of capper chucks, two of which are shown generally at 12, are supported by and rotatably driven by the turret drive system so as to facilitate application of closure caps, such as indicated at 14, onto containers, one of which is indicated at 16. The containers are supported in upright position on conveyor means 17 of conventional design adapted to effect predetermined generally constant speed movement of the containers along a predetermined path at least a portion of which passes along a straight-line path in underlying relation to a straight-line reach of the predetermined path through which the capper chucks are moved.

The capper chucks 12, which may be of the type adapted to apply preformed continuous thread closure caps to threaded neck portions of the containers 16, or may be of the type adapted to roll form an annular skirt of a closure cap radially inwardly against an external conformation on a container, are supported by turret means 18 which defines an endless or continuous closed path along which the capper chucks are moved. The turret means 18 also includes linkage and gear drive means, indicated generally at 20, operatively associated with each of the capper chucks and adapted to effect movement of the capper chucks along the predetermined guide path, with constant speed linear movement being effected along a straight-line reach of the guide path overlying the conveyor 17. As will become more apparent hereinbelow, in the preferred embodiment, the linkage and gear drive means 20 is also adapted to effect rotation of the capper chucks about their longitudinal axes as they traverse the endless guide path.

Figure 2:
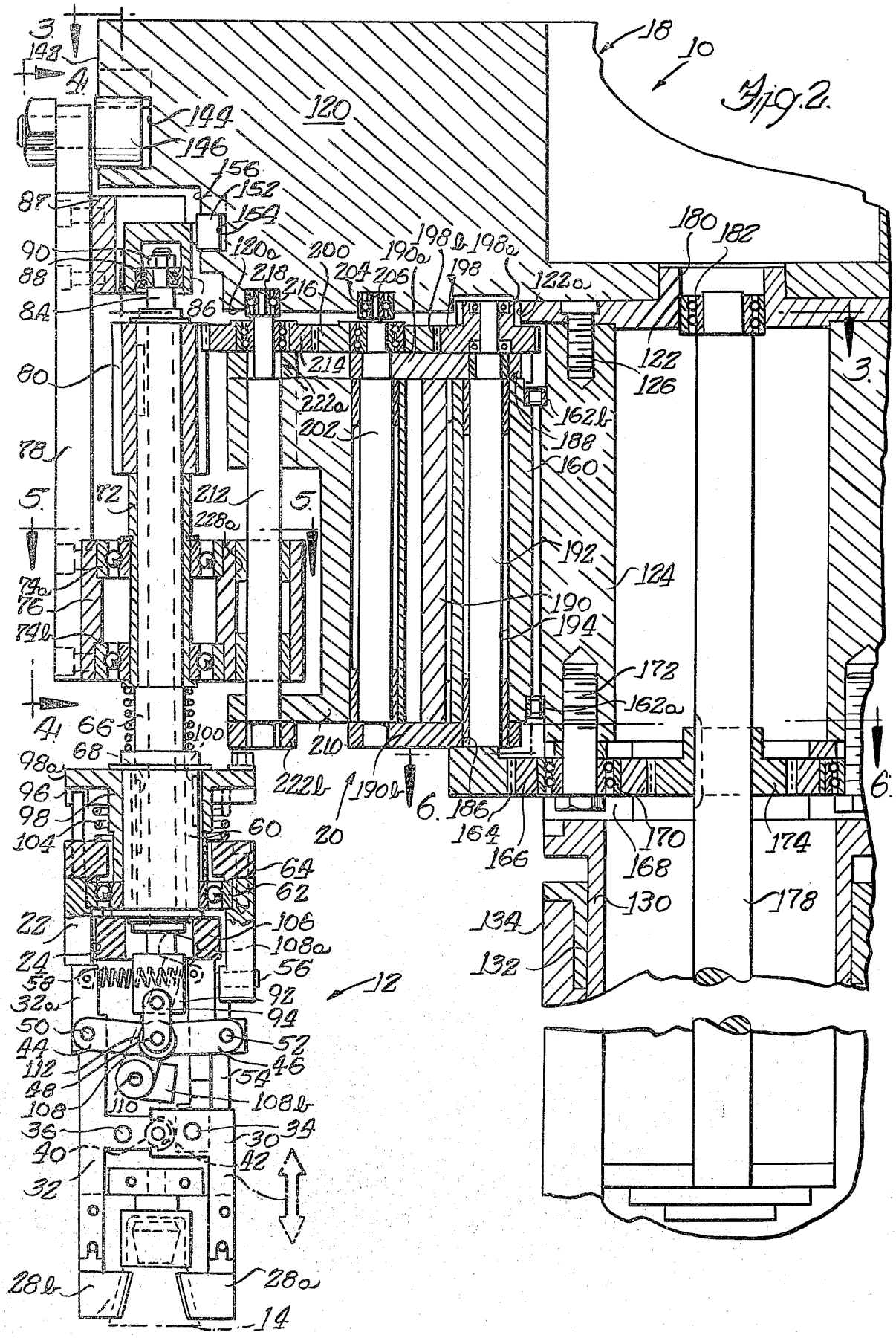
FIG. 2 is a fragmentary vertical sectional view, on an enlarged scale, illustrating one gear drive train and an associated capper chuck employed in the system of FIG. 1.

For purposes of illustration, the turret drive system 10 is illustrated in conjunction with capper chucks 12 of the type adapted to apply preformed continuous thread closure caps to containers. The capper chuck 12 may be of the type disclosed in copending application, Ser. No. 930,053, filed Aug. 1, 1978, entitled CAPPER CHUCK, which is incorporated herein by reference. With particular reference to FIG. 2, the capper chuck 12 includes a housing body 22 having a generally cylindrical outer peripheral surface and defining an internal chamber 24 intersected by a transverse slot so as to define diametrically opposed longitudinally extending openings in the housing. A pair of mutually facing identical gripper jaws 28*a* and 28*b* are releasably secured to the lower ends of a pair of operating or support arms 30 and 32 which are mounted at 34 and 36, respectively, on the housing 22 so that the gripper jaws may be moved between first or outer positions spaced outwardly from a closure cap 14, and second or inner positions in gripping relation with the closure cap as during application thereof to a container. The support arms 30 and 32 are interconnected through a cylindrical sleeve 40 carried by arm 32 and having sliding connection within a semi-cylindrical recess 42 formed in the support arm 30 so that movement of either of the gripper jaw support arms is operative to effect equal but opposite direction movement of the other support arm.

To effect movement of the gripper jaw support arms 30 and 32 between operating positions, pairs of toggle links 44 and 46 are pivotally interconnected through a connecting pin 48, the toggle link 44 being pivotally mounted at 50 to an upper extension 32*a* of the support arm 32. The toggle links 46 are pivotally connected at 52 to an arm 54 which, in turn, is pivotally mounted on the pivot shaft 34 to the housing 22 and has its upper end engaged by an adjustable set screw 56 mounted on housing 22 and enabling adjustment of the relative closed positions of the gripper jaws 28*a, b*. A coil tension spring 58 interconnects the support arm 32 to the housing 22 in a manner to bias the support arms and associated gripper jaws to their outer non-gripping positions.

The capper chuck housing 22 is mounted on a sleeve 60 through an annular bearing 62 which is retained within the housing 22 by an annular retaining ring or bearing cap 64. The sleeve 60 is mounted on a support sleeve 66 through a key 68 so as to be rotatable with the support sleeve 66. The support sleeve 66 extends upwardly through and is supported by a sleeve 72 which is fixed axially within a pair of annular bearings 74*a* and 74*b* mounted within a support block 76 secured to the lower end of a support bracket or plate 78. The support sleeve 66 has a pinion gear 80 affixed to its upper end so as to enable rotation of the capper chuck upon driving rotation of the gear 80 as will become more apparent hereinbelow.

To effect selective opening and closing of the gripper jaws 28*a, b* an actuating shaft 84 extends axially upwardly within the support sleeve 66 and has its upper end connected to an actuating block 86 through an annular bearing 88 and nut 90. The actuating block 86 is vertically slidable within a U-shaped guide block 87 mounted on bracket 78. The lower end of the actuating shaft 84 has a connecting block 92 mounted thereon which is connected to the connecting pin 48 through connecting links 94. In this manner, axial movement of the actuating shaft 84 relative to housing 22 is operative to effect movement of the toggle links 44 and 46 and thus the support arms 30 and 32 between their relative open and closed positions.

The illustrated capper chuck 12 is adapted to effect release of the associated closure cap from between its gripper jaws during application of the closure cap to a container when a predetermined rotational torque is effected between the closure cap and the corresponding container. To this end, the annular retaining ring 64 is interconnected to a torque plate 96 having adjustable connection to a flange 98*a* of a tubular reaction member 98 fixed on the sleeve 60 through a key 100. The retaining ring 64 is connected to the torque plate 96 through a coil torsion spring 104 so that rotation of the support sleeve 66 effects a corresponding rotation of the housing 22 through sleeve 60, reaction member 98 and torsion spring 104. The torsion spring 104 is selected to resist relative movement between the housing 22 and the reaction member 98 until a predetermined rotational torque is effected between the closure cap and an underlying container.

A torque release control plate 106 is formed on the lower end of sleeve 60 and has a radial slot therein adapted to receive the upper end 108*a* of a torque transfer arm 108 which is pivotally mounted on the housing 22 through a pivot shaft 110. The torque transfer arm 108 has a release foot or cam 108*b* thereon which underlies a roller 112 carried on the connecting pin 48 between the connected pairs of toggle links 44 and 46. When the predetermined torque is effected between the closure cap and the associated container, continued rotation of support sleeve 60 through pinion 80 effects a corresponding rotation of torque release control plate 106 which rotates the torque transfer arm and causes the cam 108*b* to raise the toggle links and thereby open the gripper jaws 28*a, b* and release the closure cap.

As aforementioned, the capper chuck 12 may take different designs each of which is adapted for center shaft driving rotation through a pinion gear similar to the drive gear 80. In accordance with an important feature of the present invention, the turret means 18 is adapted to support a plurality of the capper chucks 12 and effect substantially constant speed linear movement of the capper chucks through a straight-line reach of the predetermined endless path overlying the conveyor 17. The turret means 18 is also adapted to simultaneously effect rotation of the capper chucks about their longitudinal axes as they traverse the guide path.

Figure 3:
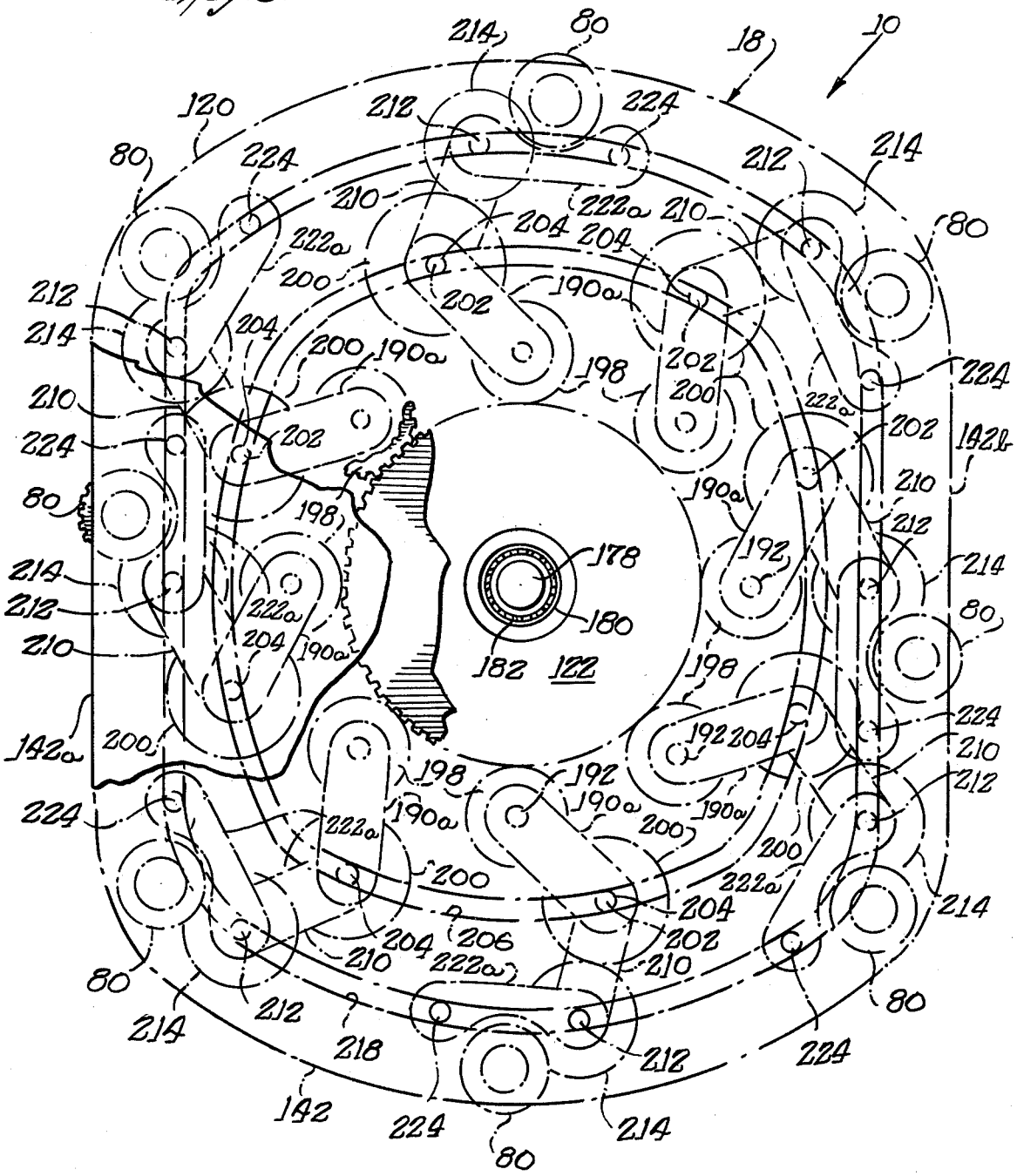
FIG. 3 is a horizontal sectional view, such as taken generally along line 3—3 of FIG. 2 looking in the direction of the arrows, but on a reduced scale and showing the complete turret and associated cam grooves for guiding the gear train drives and associated capper chucks about the periphery of the turret.

With particular reference to FIGS. 1–3, the turret means 18 includes a turret plate 120 which, in the illustrated embodiment, has a generally over-like plan configuration as best seen in FIG. 3. The turret plate 120 is supported in a substantially horizontal plane spaced above a base platform 121 on which the container conveyor means 17 is supported so that the conveyor means underlies a straight-line reach of the path traversed by the capper chucks 12. As best seen in FIG. 2, the turret plate 120 is fixed coaxially on a bull gear 122 which in turn is fixed on the upper end of an annular cage 124 through a plurality of screws, one of which is shown at 126. The annular cage 124 is mounted on the upper end of a tubular sleeve 130 which is telescopingly received within an annular guide bushing 132 fixed within the upper end of a support tube 134. The support sleeve 130 is suitably keyed within the support tube 134 for nonrotating telescoping movement relative thereto. The support sleeve 130 has a rack 136 secured longitudinally thereto, as best seen in FIG. 1, which is engaged by an elevator drive pinion 138 connected to a suitable drive motor (not shown) so as to facilitate axial elevation of the support sleeve 130 and turret plate 120 relative to the support platform 121. In this manner, the turret means 18 and associated capper chucks 12 may be adjusted vertically to accommodate different height containers during capping thereof.

Figure 4:
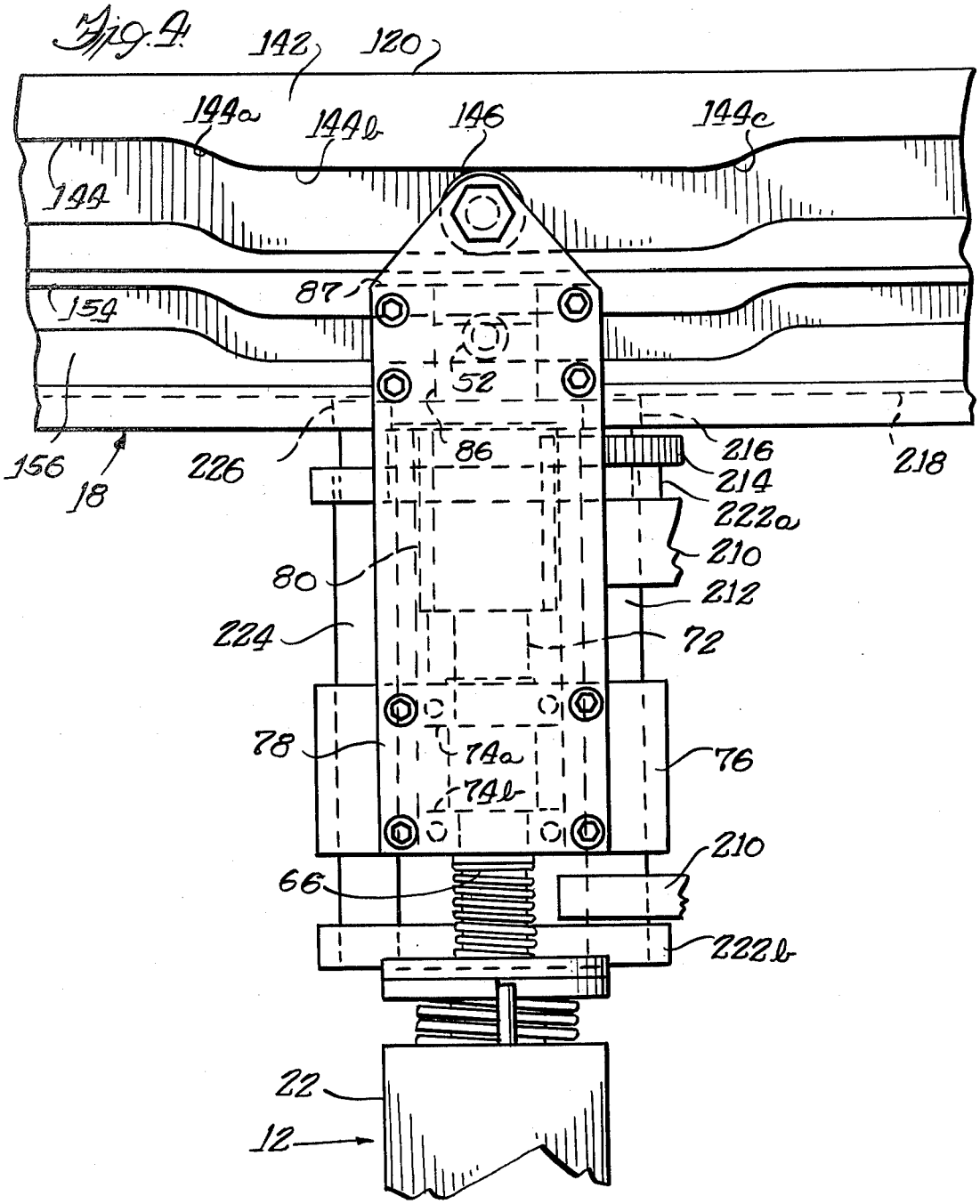
FIG. 4 is a partial elevational view taken substantially along line 4—4 of FIG. 2, looking in the direction of the arrows.
Figure 5:
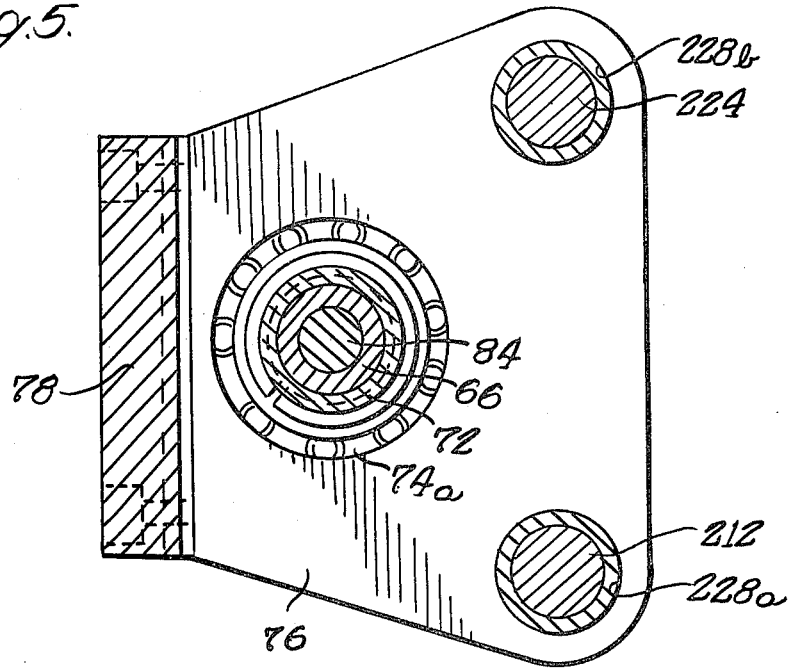
FIG. 5 is a fragmentary transverse sectional view, on an enlarged scale, taken substantially along line 5—5 of FIG. 2, looking in the direction of the arrows.

The turret plate 120 has an outer peripheral vertical surface 142 in which is formed a continuous or endless cam groove or slot 144 as best seen in FIGS. 1, 2 and 4. The cam groove 144 defines an endless guide track which receives a plurality of cam follower rollers 146 each of which is rotatably mounted on the upper end of a capper chuck support bracket 78. The cam groove 144 serves as an elevational control cam for the capper chucks and has a predetermined elevational contour to provide predetermined vertical movement of each capper chuck 12 as it traverses the endless path defined by the cam groove 144. For this purpose, the cam groove 144 has an elevation throughout the major portion of its path sufficient to maintain the capper chucks spaced a greater distance above the support platform 121 than is necessary during a capping operation. In the illustrated embodiment, the cam groove 144 is similarly contoured on diametrically opposite sides of the turret plate 120 along straight substantially planar surface portions 142*a* and 142*b* so as to lower each capper chuck during movement along the straight-line reach defined by planar side surface 142*a* overlying the conveyor means 17. Each capper chuck is raised by the cam groove 144 after passing along turret side 142*a* and is advanced to the side 142*b* of the turret plate opposite the container conveyor means 17 during which each capper chuck is lowered to pick up a closure cap 14 from a suitable closure cap feeding apparatus (not shown) of known design preparatory to applying the closure cap to the upper threaded end of a container brought into axial underlying relation with the capper chuck as it traverses the straight-line reach along side 142*a*.

FIG. 4 illustrates a portion of the cam groove 144 representative of both sides 142*a, b* of the turret plate 120 for effecting predetermined vertical movement of the capper chucks. The cam groove 144 is inclined downwardly at 144*a* within the linear or straight-line portion 142*a* of the guide path, then extends for a predetermined distance in a horizontal dwell segment 144*b*, followed by an upwardly inclined rise portion 144*c* which returns the capper chuck to its starting elevation while still disposed within the straight-line reach of the guide path. The vertical distance between the cam dwell portion 144*b* and the main cam groove 144 is selected to establish the desired downward movement of the capper chuck during cap pickup and subsequent capping of a container.

To effect predetermined closing of the gripper jaws 28*a, b* about a closure cap 14 during closure cap pickup, the upper end of the actuating shaft 48 has a cam follower roller 152 mounted on the actuating block 86. The cam follower roller 152 is received in guided relation within a cam groove 154 formed in a vertical peripheral surface 156 on the turret plate 120 which is parallel to surface 142 peripherally of the turret plate. The cam groove 154 also serves as an elevational control cam and, in the case of capper chucks for use with continuous pre-threaded closure caps, has a predetermined elevational contour relative to cam groove 144 so as to effect the desired downward movement of the actuating shaft 84 relative to the capper chuck housing 22 and close the gripper jaws 28*a, b* about a closure cap as the capper chuck passes the closure cap feeding station generally diametrically opposite the container conveyor means 17. The remaining portion of the cam groove 154 is substantially parallel to the cam groove 144.

In accordance with an important feature of the turret system 10, the turret means 18 includes linkage and gear drive means 20 operatively associated with each of the capper chucks carried by the turret means and operative to effect predetermined substantially constant speed movement of the capper chucks as they traverse the straight-line path overlying the conveyor means 17. The straight-line speed of the capper chucks is preferably synchronized with the speed of the conveyor means 17 so that the capper chucks travel at the same speed as containers moving along the conveyor. Another important feature lies in the ability of the linkage and gear train means 20 to effect predetermined continuous rotation of each capper chuck about its longitudinal axis as it travels along the endless guide track.

Figure 6:
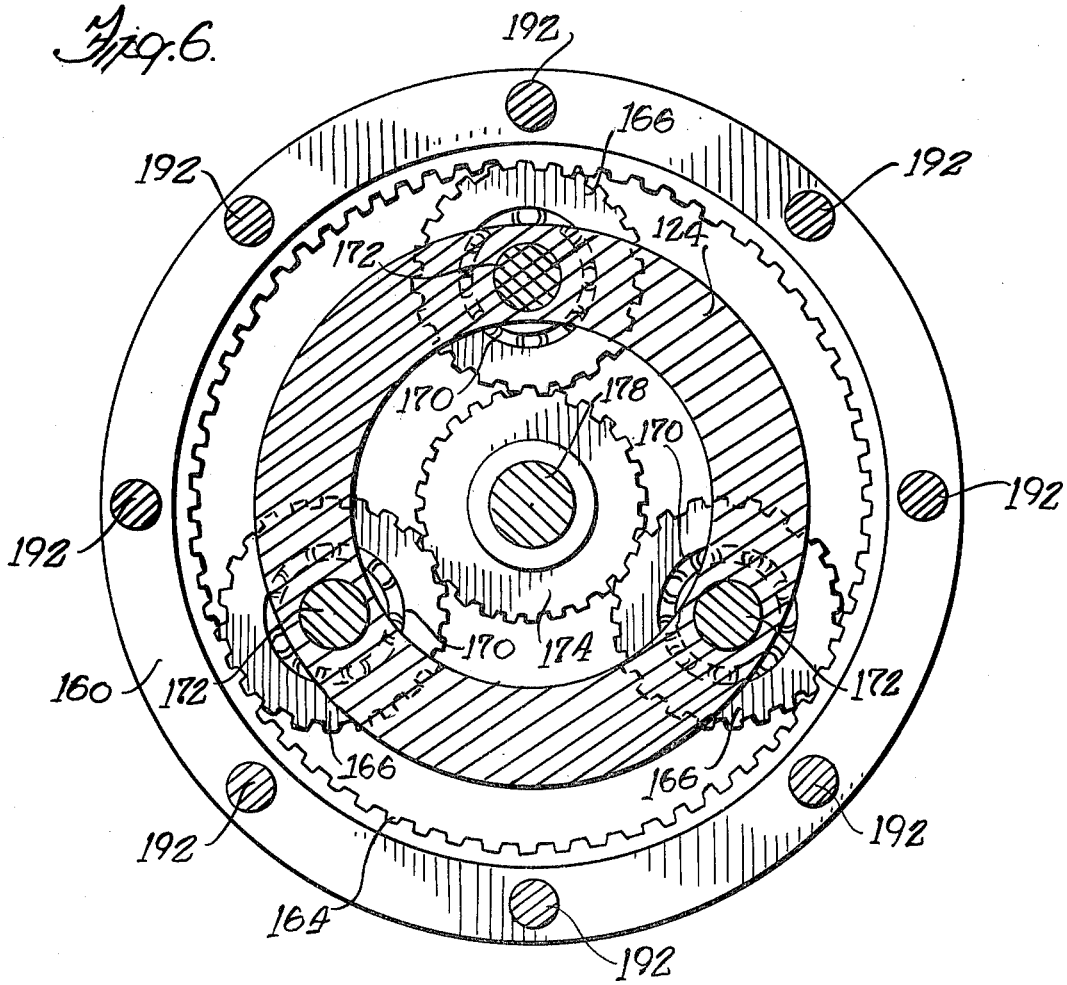
FIG. 6 is a fragmentary transverse sectional view, on an enlarged scale, taken substantially along line 6—6 of FIG. 2.

As best seen in FIGS. 2, 3 and 6, an annular gear cage 160 is rotatably supported coaxially on the fixed annular cage member 124 through a pair of longitudinally spaced radial thrust bearing 162*a* and 162*b*. The lower end of the annular gear cage 160 has gear teeth 164 formed on its annular inner peripheral surface for meshing engagement with three equidistantly circumferentially spaced transfer gears 166 mounted within suitable radial slots 168 in the fixed annular cage 124, each of the transfer or idler gears 166 being supported through a bearing 170 on the shank of a support screw 172 secured to the annular fixed cage 124. The transfer gears 166 have meshing driven relation with a drive pinion gear 174 secured on a vertical drive shaft 178 which defines the longitudinal axis of the turret drive system 10. The upper end of the drive shaft 178 is preferably rotatably mounted within an axial bore 180 in the bull gear 122 through an annular bearing 182. The lower end of the drive shaft 178 is secured to the output shaft of a suitable drive motor (not shown) through a telescoping keyed connection either directly or through a gear transmission operative to effect a constant predetermined rotational speed of the drive shaft.

In the illustrated embodiment, the turret means 18 is adapted to support eight capper chucks 12 spaced equidistantly circumferentially about the axis of the turret plate 120 at approximately 45° angles subtended between radii intersecting the axes of adjacent chucks. For this purpose eight radial slots 186 are formed in the annular cage 160 at equidistantly circumferentially spaced positions about the axis of the annular gear cage. Each slot 186 cooperates with an upper end surface 188 on the gear cage 160 to receive and support parallel arm portions 190*a* and 190*b* of a connecting link 190 having pivotal connection to the gear cage through a pivot shaft 192 received through suitable axially aligned bores in the link arms 190*a, b* and through a suitable bore 194 formed in the gear cage.

The upper end of the pivot shaft 192 rotatably supports a stepped pinion gear 198 having a first annular gear tooth surface 198*a* adapted to intermesh with peripheral gear teeth 122*a* on the fixed bull gear 122. The pinion gear 198 has a second annular gear tooth surface 198*b* of larger pitch diameter than gear tooth surface 198*a* and having meshing relation with a transfer gear 200. The transfer gear 200 is rotatably mounted on the upper end of a pivot shaft 202 which is pivotally mounted on and between link arms 190*a* and 190*b* of the connecting link 190.

With the gear drive means 20 thus far described, it will be understood that driving rotation of the drive pinion 174 will effect rotation of the annular gear cage 160 through the three transfer gears 166. As gear cage 160 rotates, the upper pinion gear 198 is caused to rotate due to its meshing engagement with gear teeth 122*a* on the bull gear 122 so as to effect a corresponding rotation of the transfer gear 200 in an opposite rotational direction. To maintain the axis of the transfer gear 200 in predetermined relation to the axis of the pinion gear 198, the upper end of the pivot shaft 202 has a cam follower roller 204 rotatably mounted thereon which is received within a cam groove or slot 206 formed in the lower surface 120*a* of the turret plate 120, as best seen in FIGS. 2 and 3. The cam slot 206 has a predetermined planar contour relative to the axis of the turret plate 120 as will become more apparent hereinbelow.

A second connecting link 210 is pivotally mounted on the pivot shaft 202 between the link arms 190*a, b* and serves to support a pivot shaft 212 in parallel relation to the pivot shafts 192 and 202. The upper end of the pivot shaft 212 rotatably supports a drive gear 214 which has meshing engagement with the transfer gear 200 and with the drive gear 80 on the associated capper chuck 12. A cam follower roller 216 is rotatably mounted on the upper end of pivot shaft 212 and is received within a cam groove or slot 218 formed in the lower surface 120*a* of the turret plate 120. The cam groove 218 has a predetermined contour, when considered in plan view as in FIGS. 3 and 7, and along with the elevational control cam groove 144 defined the predetermined path along which the capper chucks travel about the axis of the turret means 18. The outer surfaces 142 and 156 are formed parallel to the cam groove 218. The cam groove 206 also has predetermined relation to cam groove 218.

A pair of connecting links 222*a* and 222*b* are mounted on the pivot shaft 212 to abut the upper and lower surfaces, respectively, of the connecting link 210. The links 220*a, b* support a follower shaft 224 in parallel spaced relation to the pivot shaft 212. The upper end of shaft 224 has a cam follower 226 (FIG. 4) rotatable thereon similar to follower 216 and which is received within the cam slot 218 in trailing relation to the cam follower 216.

The bearing support block 76 has a pair of parallel spaced bores 228*a* and 228*b* formed therethrough having bushings therein to receive the parallel shafts 214 and 224 in sliding relation. The shafts 212, 224 permit vertical movement of the bearing support block 76 thereon while maintaining the support block and associated capper chuck in predetermined orientation relative to the turret plate 120 so as to maintain the desired driven engagement of the capper chuck drive gear 80 with rotational drive gear 214 as the associated capper chuck 12 traverses the endless path defined by the cam groove 218 in the turret plate.

As aforementioned, the cam grooves 206 and 218 have predetermined relation to each other and to the axis of the turret plate 120 and the associated drive shaft 178. FIG. 7 schematically illustrates an example of the relationship of the cam grooves 206 and 218 so as to effect linear constant speed travel of the capper chucks along the straight line reach or run of the path traveled by the capper chucks about the turret plate. Such straight line reach or run is represented by the straight line portion 218*a* of the cam groove 218 in FIG. 7.

The planar contour of the cam groove 218 is established so as to bring successive ones of the capper chucks 12 along a straight line path overlying the straight line axis of the conveyor means 17, as represented by the line 232 in FIG. 7. In the illustrated embodiment wherein the capper chucks 12 are adapted to apply continuous thread type closure caps to the externally threaded upper end portions of containers 16 which are moved along the conveyor means 17, the straight line portion 218*a* of the cam groove 218 is of sufficient length that the capper chucks will travel in overlying relation to the conveyor means for a period sufficient to fully apply a closure cap to an underlying container. It will be appreciated that by providing straight line movement of the containers during capping, the containers and contents are not subjected to centrifugal forces which might tend to spill the contents as has been encountered in prior capping systems employing infeed and outfeed stars to effect movement of containers relative to a capping station.

The semi-circular line 234 of FIG. 7 represents one-half of the circular path traversed by the axes of the drive pinions 198 during driving rotation of the annular gear cage 160. Assuming the line indicated at 236 in FIG. 7 which passes through the center of the turret plate 120 to be a "zero" reference line, points may be marked on the semi-circular line 234 at equal angular increments, such as five degree increments, as illustrated. With the axis 192 of each pinion gear 198 in the illustrated embodiment being interconnected through equal length connecting links 190 and 210 to an associated pivot shaft 212 which has fixed relation to the axis of the actuating shaft 84 of the corresponding capper chuck 12, the cam groove 206 is contoured along its length proximate the straight line portion 218*a* of cam groove 218 so that with each incremental rotational advance of the associated drive pinion 198 about the axis 178, such as five degrees, the corresponding pivot shaft 212, which has its upper end disposed within the cam groove 218, advances equal predetermined incremental distances along the straight line portion 218*a* of the cam groove 218. In the illustrated embodiment, for each five degree incremental rotational advance of a drive pinion 198, the axis of the associated pivot shaft 212 moves 0.75 inch. The cam groove 206 is contoured so that the axis 202 of the corresponding gear 200 is disposed in a position to effect such constant linear advance of the associated pivot shaft 212 for each incremental rotational advance of the gear cage 160 and drive pinions 198 carried thereby.

FIG. 7*a* schematically illustrates an example of an elevational contour of the cam groove 144 relative to the straight line portion 218*a* of the cam groove 218 in FIG. 7 so that the capper chucks move at a constant linear speed along the straight line path overlying the conveyor means 17, as represented by line 232 by FIG. 7, during a capping operation. In the illustrated embodiment, the cam groove 155 is contoured downwardly at 144*a* so as to begin lowering each capper chuck to a substantially horizontal path defined by the cam groove portion 144*b* after the capper chuck enters the linear guide path portion 218*a*. As each capper chuck traverses the cam groove portion 144*b*, it is operated to apply a closure cap to the threaded neck portion of a container carried on the conveyor means 17, followed by raising the capper chuck through the cam groove portion 144*c*.

As aforementioned, the planar cam grooves 206 and 218 in the turret plate 120 are diametrically symmetrical. The portions of the cam grooves 206 and 218 which interconnect the diametrically opposed straight line portions of the cam groove 218, as represented by the straight line portion 218*a* in FIG. 7, may be suitably configured so as to guide the capper chucks in relatively smooth motion as they approach and enter the straight line portions of their paths of travel and thereafter leave such straight line portions without subjecting the capper chucks to undesirable acceleration forces.

In the illustrated embodiments wherein the capper chucks are employed to apply continuous thread type closure caps to containers, as successive capper chucks pass through the straight line cam path portions of cam path 218, i.e. as represented by the portion 218*a* of cam groove 218, during a capping operation, the capper chucks undergo sufficient rotational movement about their longitudinal axes while in their lowered positions in elevational cam slot 144*b* so as to complete the application of a continuous thread type closure cap to the upper threaded neck end of an underlying container. In the illustrated embodiment, each capper chuck is rotated about its longitudinal axis approximately two and three-fourth turns as the capper chuck traverses the cam groove portion 144*b* of the control cam groove 144.

It will be appreciated that the rotation imparted to the capper chucks as they traverse the cam groove portion 144*b* is established by selection of the drive train gears 122*a*, 198*a*, 198*b*, 200, 214 and 80. In one example, the various gears may comprise 12 pitch spur gears selected so that 122*a* comprises a 180 tooth gear, 198*a* comprises a 21 tooth gear, 198*b* comprises a 40 tooth gear, 200 comprises a 48 tooth gear, 214 comprises a 40 tooth gear, and 80 comprises an 18 tooth gear. Using these gear ratios, the linkages 190 and 210 are designed so that the distances between axes 192 and 202, and between axes 202 and 212 are approximately 3.667 inches. With this sizing, each capper chuck will undergo approximately 2 ¾ revolutions as it passes along a travel path of approximately 6.98 inches through the cam groove portion 144*b* of the control cam groove 144.

It will be appreciated that by eliminating the rotational drive gears 198, 200 and 214, and, if desired, the bull gear 122, rotation of the annular gear cage 160 through drive pinion 174 will effect movement of associated operating devices, such as the illustrated capper chucks 12, about the turret plate 120 without effecting rotation of the operating devices about their longitudinal axes. This feature may be particularly desirable when employing operating devices which do not require rotation to accomplish their desired operating functions. The gear cage 160, drive pinion 174 and rotational speed of the drive pinion 174 may thus be selected to provide predetermined constant rectilinear speed of the operating devices along the straight line reaches, e.g., along the sides 142*a* and 142*b*, of the turret plate 120 in synchronized relation to the speed of the conveyor means 17. The rotational speed of the drive pinion 174 may be interconnected to the drive means or conveyor means 17 through mechanical or electrical feedback interconnection of known design to provide the desired synchronized relation therebetween.

In the illustrated embodiment, the contours of the cam grooves 206 and 218, and the particular rotational drive gears 198, 200 and 214 are established so that intermeshing relation between the rotational drive gears is maintained and the pinion gear 214 of each drive train has continuous meshing engagement with the drive pinion 80 of the associated capper chuck 12 to maintain substantially constant speed rotation of each capper chuck about its longitudinal axis as the capper chuck traverses the endless path driven by the annular gear cage 160 and drive gear 174. It will be understood that in the described embodiment the gear ratios for the drive gear 174, transfer gear 166, gear cage 160, bull ring 122, rotational drive gears 198, 200 and 214, and drive pinion gears 80 are selected to maintain predetermined travel speeds of the capper chucks about the turret plate 120 while simultaneously maintaining predetermined substantially constant speed rotation of the capper chucks about their longitudinal axes. The linkages 190 and 210 cooperate with the shafts 192, 202 and 212 and support blocks 76 to define linkage means interconnecting the associated capper chucks with the gear train gears 122, 198, 200 and 214 to maintain driving rotation of the capper chucks as they traverse the endless guide track about turret 120 irrespective of varying radial distance from the center axis of the turret.

As aforedescribed, the endless guide path defined by the cam grooves 218 and 144 in the turret block 120 includes substantially straight line reaches along opposite sides 142*a, b* of the turret block so that the capper chucks traverse one straight line reach during application of closure caps to axially underlying containers carried on the conveyor means 17, and traverse the opposite straight line reach during closure cap pick up.

Having thus described a preferred embodiment of the turret drive system 10 in accordance with the present invention, its operation will now be briefly reviewed. With eight operating devices in the form of capper chucks 12 mounted on the turret plate 120 in equidistantly spaced relation about its center axis, and with each of the capper chucks being caused to traverse the endless guide path through rotation of the pinion gear 174 and gear cage 160 while simultaneously undergoing rotation about its longitudinal axis through the rotational drive gears 198, 200 and 214, each capper chuck will successively pass through the straight line reach of the endless path overlying the closure cap feeding station (not shown) during which time the cam groove 144 is operative to lower the capper chuck and the cam groove 154 is contoured to effect closing of the gripper jaws 28*a, b* about a closure cap.

After picking up a closure cap, each capper chuck continues movement through the endless path to the straight line reach overlying the container conveyor means 17 during which the capper chucks travel at substantially constant speed and the cam groove 144 effects downward movement of the successive capper chucks to effect engagement of the associated closure cap carried thereon with the upper threaded neck portion of an axially underlying container 16. As the capper chucks traverse the endless path defined by the turret plate 120, they undergo substantially constant rotation about their longitudinal axes through rotation of the pinion gear 174 at a rotational speed suitable to apply the respective closure caps to the underlying containers. When the closure caps have been applied to their associated containers at a predetermined torque, the capper chucks are operative to release the closure caps after which the capper chucks are again raised and passed again to the closure cap pick up station. It will be appreciated that the contour of the cam groove 154 is such as to allow axial upward movement of the capper chuck actuating shafts 84 when the gripper jaws 28*a, b* released through operation of the torque transfer arms 108.

Having thus described a preferred embodiment of the turret drive system in accordance with the present invention, it will be understood that changes and modifications may be made therein without departing from the invention in its broader aspects.

Various features of the invention are defined in the following claims.

What is claimed is:

1. A system for moving at least one operating device through a predetermined endless path, said system including, in combination, a substantially horizontally disposed turret plate having a center axis and defining an endless guide track circumferentially of said center axis, a primary drive shaft, at least one operating device supported by said turret plate and having operative relation with said endless guide track for movement therealong and relative thereto with the axis of said operating device disposed substantially normal to said turret plate, and means interconnecting said operating device to said primary drive shaft so that rotation of said primary drive shaft effects movement of said operating device along said endless guide track, wherein said last mentioned means includes gear drive means operative to effect substantially constant speed movement of said operating device along said endless track, said endless guide track varies in its radial distance from the center axis of said turret, and said last mentioned means further includes linkage means interconnecting said operating device with said gear train means.

2. The system as defined in claim 1 wherein said primary drive shaft has a longitudinal axis substantially normal to said turret plate and intersecting said center axis thereof.

3. The system as defined in claim 1 wherein said means interconnecting said operating device to said primary drive shaft to effect movement of said operating device along said endless guide track includes means to effect simultaneous rotation of said operating device about its longitudinal axis.

4. The system as defined in claim 3 wherein said interconnecting means includes gear drive means operative to effect both movement of said operating device along said endless guide track and said simultaneous rotation of said operating device about its longitudinal axis.

5. A system as defined in claim 4 wherein said gear drive means includes gear train means having operative connection with said operating device and with said primary drive shaft such that rotation of said drive shaft effects rotation of said operating device about its axis of rotation.

6. A system as defined in claim 1 wherein said turret plate supports a plurality of operating devices having operative relation with said endless guide track for movement therealong with the axes of said operating devices disposed substantially normal to said turret plate, and including means interconnecting each of said operating devices to said primary drive shaft independently of each other but in a manner to effect rotation of said operating devices about their longitudinal axes while simultaneously effecting movement of said plurality of operating devices along said endless guide track.

7. A system as defined in claim 6 including gear train means operatively associated with each of said operating devices and interconnecting each of said operating devices to said primary drive shaft such that rotation of said drive shaft effects rotational movement of each of said operating devices about its longitudinal axis while simultaneously undergoing movement along said endless guide track.

8. A system as defined in claim 7 wherein each of said gear train means includes a guide shaft disposed parallel to the axis of said primary drive shaft, each of said guide shafts being operatively associated with said turret for movement through a predetermined path as said operating devices are caused to traverse said endless guide track.

9. A system as defined in claim 7 wherein said turret includes a plurality of cam guides, each of said guide shafts having an end thereof cooperative with one of said cam guides so as to be guided through a predetermined path during a full cycle of movement of the associated operating device.

10. A system as defined in claim 9 wherein said cam guides are defined by cam slots formed in said turret plate and are radially spaced from the center axis of said turret plate so as to maintain each gear train in continual driving relation with its associated operating device as said operating device traverses said endless guide track.

11. The system as defined in claim 1 wherein said endless guide track is substantially diametrically symmetrical about the axis of said turret plate.

12. The system as defined in claim 1 wherein said operating device includes housing means interconnected to said turret plate and said endless guide track for movement therealong circumferentially of said turret plate, said turret plate having an elevational control cam therein extending circumferentially of said turret plate and having predetermined relation to said endless guide track, said operating device including an actuating shaft disposed coaxially of said housing means and adapted for axial movement relative to said housing means, and means interconnecting said actuating shaft to said elevational control cam so as to effect predetermined axial movement of said actuating shaft relative to said housing means as said operating device traverses said endless guide track.

13. The system as defined in claim 12 wherein said operating device includes at least one operating arm pivotally supported by said housing means for movement between first and second positions relative to said housing means, said operating arm being cooperable with said actuating shaft so that predetermined movement of said actuating shaft is operative to move said operating arm from said first to said second positions, said elevational control cam being configured to effect said predetermined movement of said operating arm as said operating device traverses said endless guide track.

14. The system as defined in claim 13 wherein said operating device comprises a capper chuck having at least two operating arms adapted for cooperating relation to grasp a closure cap therebetween when moved between first and second positions relative to said housing means, said operating arms having operative association with said actuating shaft so as to be moved between said first and second positions upon predetermined movement of said actuating shaft, said elevational control cam being configured to effect said predetermined movement of said actuating shaft as said capper chuck traverses said endless guide track.

15. A system for moving at least one operating device through a predetermined endless path, said system including, in combination, a substantially horizontally disposed turret plate having a center axis and defining an endless guide track circumferentially of said center axis, a primary drive shaft, at least one operating device supported by said turret plate and having operative relation with said endless guide track for movement therealong and relative thereto with the axis of said operating device disposed substantially normal to said turret plate, and means interconnecting said operating device to said primary drive shaft so that rotation of said primary drive shaft effects movement of said operating device along said endless guide track, wherein said turret plate defines an endless guide track having at least one straight-line reach along which said operating device traverses, said interconnecting means including means adapted to effect constant speed linear movement of said operating device along said straight-line reach as said operating device traverses said guide track.

16. The system as defined in claim 15 wherein said means adapted to effect constant speed linear movement of said operating device includes linkage and gear drive means.

17. The system as defined in claim 16 wherein said linkage and gear drive means is further adapted to effect rotation of said operating device about its longitudinal axis as it traverses said guide track.

* * * * *